US008721274B2

(12) United States Patent
Han

(10) Patent No.: US 8,721,274 B2
(45) Date of Patent: May 13, 2014

(54) BLOWER AND AIR CONDITIONER HAVING THE SAME

(75) Inventor: Jae Oh Han, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1069 days.

(21) Appl. No.: 12/222,603

(22) Filed: Aug. 12, 2008

(65) Prior Publication Data

US 2009/0145583 A1 Jun. 11, 2009

(30) Foreign Application Priority Data

Dec. 6, 2007 (KR) ..... 10-2007-0125977

(51) Int. Cl.
*F04D 29/00* (2006.01)

(52) U.S. Cl.
USPC ..... 415/203; 62/426; 415/204; 415/212.1; 415/409; 415/231

(58) Field of Classification Search
USPC ..... 62/426; 415/203, 204, 212.1, 409, 231
See application file for complete search history.

(56) References Cited

U.S. PATENT DOCUMENTS

| | | | | | |
|---|---|---|---|---|---|
| 3,286,914 | A * | 11/1966 | Baverstock | 415/119 |
| 3,524,328 | A * | 8/1970 | Schuster | 62/285 |
| 4,421,457 | A * | 12/1983 | Yoshinaga et al. | 415/208.3 |
| 5,399,068 | A * | 3/1995 | Park | 415/204 |
| 5,921,094 | A * | 7/1999 | Bang et al. | 62/126 |
| 5,944,481 | A * | 8/1999 | Stone et al. | 415/53.1 |
| 5,997,246 | A * | 12/1999 | Humbad | 415/119 |
| 6,881,031 | B2 * | 4/2005 | Nomura | 415/203 |
| 6,953,319 | B2 * | 10/2005 | Sohn et al. | 415/119 |
| 2004/0062646 | A1 | 4/2004 | Nomura | |

FOREIGN PATENT DOCUMENTS

| | | |
|---|---|---|
| CN | 1085994 | 4/1994 |
| JP | 10220398 | 8/1998 |
| KR | 100269375 | 7/2000 |
| KR | 10-2003-0043464 | 6/2003 |
| KR | 2003-0072949 | 9/2003 |
| KR | 10-2006-0089125 | 8/2006 |

OTHER PUBLICATIONS

Chinese Office Action dated Jan. 13, 2012 from Chinese Patent Application 200810214488.2.
Korean Office Action from Korean Patent Application No. 10-2007-0125977 dated Oct. 10, 2012.
Chinese Office Action from Chinese Patent Application No. 200810214488.2 dated Nov. 26, 2012.

* cited by examiner

*Primary Examiner* — Cheryl J Tyler
*Assistant Examiner* — Jonathan Koagel
(74) *Attorney, Agent, or Firm* — Staas & Halsey LLP

(57) ABSTRACT

A blower having a divergence guide portion to reduce flow loss and discharge noise and an air conditioner having the same are provided. The blower includes a scroll casing, suction holes provided at opposite positions of the scroll casing, a discharge hole provided at a top position of the scroll casing, a centrifugal fan received in the scroll casing, and a divergence guide portion gently diverging air to the discharge hole after passing through the centrifugal fan to diffuse the air to both sides of the discharge hole.

16 Claims, 4 Drawing Sheets

BLOWER AND AIR CONDITIONER HAVING THE SAME

CROSS-REFERENCE TO RELATED APPLICATIONS

This application claims the benefit of Korean Patent Application No. 2007-0125977, filed on Dec. 6, 2007 in the Korean Intellectual Property Office, the disclosure of which is incorporated herein by reference.

BACKGROUND

1. Field

The present invention relates to a blower, and, more particularly, to a blower having a divergence guide portion to reduce flow loss and discharge noise, and an air conditioner having the same.

2. Description of the Related Art

A blower is a device to generate air flow, and is used in a variety of appliances such as air conditioners, air purifiers, cleaners, refrigerators, etc.

A conventional blower includes a cylindrical scroll casing and a centrifugal fan received in the scroll casing. The scroll casing is formed, at opposite positions thereof, with two suction holes, respectively. A discharge hole is formed in a tangential direction of the scroll casing.

The above-described blower operates on the following principle. If the centrifugal fan is operated by a motor, surrounding air around the blower is suctioned by a suction force of the centrifugal fan through both the suction holes. In this case, the surrounding air having passed through the suction holes arranged at opposite positions of the blower creates individually-suctioned air streams. These suctioned air streams are discharged in a radial direction of the centrifugal fan, and thereafter, flow to a discharge hole along an inner circumference of the scroll casing to be discharged to the outside of the blower.

The above-described blower is called a double-suction-type blower because air is suctioned through the respective suction holes provided at opposite sides of the centrifugal fan. The double-suction-type blower is advantageous in view of a larger blowing capacity, as compared to a blower designed to suction air unidirectionally.

However, while flowing to the discharge hole after passing through the centrifugal fan, the individual air streams suctioned through both the suction holes are liable to collide and be mixed with each other by an inertial force thereof toward the center of the blower. Therefore, the above-described conventional blower undergoes serious flow loss and discharge noise.

To prevent the collision and mixing of air streams, Korean Patent Laid-Open No. 10-2003-0072949 discloses a blower, which includes a partition to divide an entire space between a scroll casing and a centrifugal fan to isolate air streams suctioned through both suction holes arranged at opposite positions of the blower from each other.

However, the blower disclosed in Korean Patent Laid-Open No. 10-2003-0072949 has a problem in that the air streams having passed through the centrifugal fan, collide with the partition, thus still causing serious flow loss and discharge noise.

Further, the above-described blower including the partition requires a troublesome fabrication process. Specifically, when the blower is fabricated via injection molding, an insert having a complicated configuration is necessary. Also, when the blower is fabricated via pressing, an additional welding process is necessary.

SUMMARY

Accordingly, it is an aspect of the embodiment to provide a blower, which can restrict collision and mixing of air streams suctioned through both suction holes arranged at opposite positions of the blower, thereby reducing flow loss and discharge noise, and an air conditioner having the same.

It is a further aspect of the embodiment to provide a blower, which can reduce fabrication time and costs with a simplified fabrication process thereof, and an air conditioner having the same.

Additional aspects and/or advantages will be set forth in part in the description which follows and, in part, will be obvious from the description, or may be learned by practice of the invention.

In accordance with an aspect of the invention, the above and/or other aspects can be achieved by the provision of a blower, including: a scroll casing; suction holes provided at opposite positions of the scroll casing; a discharge hole provided at a top position of the scroll casing; a centrifugal fan received in the scroll casing; and a divergence guide portion of the scroll casing extending to the discharge hole provided at the top position of the scroll casing gently diverging air flowing to the discharge hole after passing through the centrifugal fan to diffuse the air to opposing sides of the discharge hole.

The divergence guide portion may be inwardly bent along an inner circumference of the scroll casing.

The divergence guide portion may be bent to have a V-shaped cross section.

A bending depth and a bending width of the divergence guide portion may increase along an air flow direction.

A width of the scroll casing may increase along an air flow direction such that a cross section of a discharge flow path expands along the air flow direction.

The may further include an inner cut-off region between the scroll casing and the centrifugal fan, and the divergence guide portion starts at a point between 180° and 270° in the air flow direction from the cut-off region.

The foregoing and/or other aspects are achieved by providing an air conditioner, including a suction grill suctioning outside air; a heat exchanger receiving the air suctioned through the suction grill; a discharge grill discharging the air to the outside; and a blower forcibly blowing the outside air suctioned through the suction grill and passed through the heat exchanger to the discharge grill, the blower including a scroll casing, suction holes provided at opposite positions of the scroll casing, a discharge hole provided at a top position of the scroll casing, a centrifugal fan received in the scroll casing, and a divergence guide portion of the scroll casing extended to the discharge hole provided at the top position of the scroll casing diverging air flowing to the discharge hole after passing through the centrifugal fan to diffuse the air to opposing sides of the discharge hole.

The divergence guide portion may be inwardly bent along an inner circumference of the scroll casing.

The divergence guide portion may be bent to have a V-shaped cross section.

A bending depth and a bending width of the divergence guide portion may increase along an air flow direction.

A width of the scroll casing may increase along an air flow direction such that a cross section of a discharge flow path expands along the air flow direction.

The blower may further include an inner cut-off region between the scroll casing and the centrifugal fan, and the divergence guide portion starts at a point between 180° and 270° in the air flow direction from the cut-off region.

The foregoing and/or other aspects are achieved by providing a blower for an air conditioner, including: a scroll casing having an air discharge hole at a top thereof and a divergence guide portion extending along an inner circumference of the scroll casing, the divergence guide portion diverging air received along the inner circumference of the scroll casing to opposing sides of the discharge hole; and a centrifugal fan causing the air to flow toward the discharge hole.

The divergence guide portion may turn the air toward opposite side surfaces of the scroll casing.

The divergence guide portion may be inwardly bent along the inner circumference of the scroll casing based on a central line bisecting the scroll casing.

The divergence guide portion may include a skirt portion extending from the scroll casing such that the divergence guide portion is extended to an outside of the blower.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF THE EMBODIMENT

Figure 1:
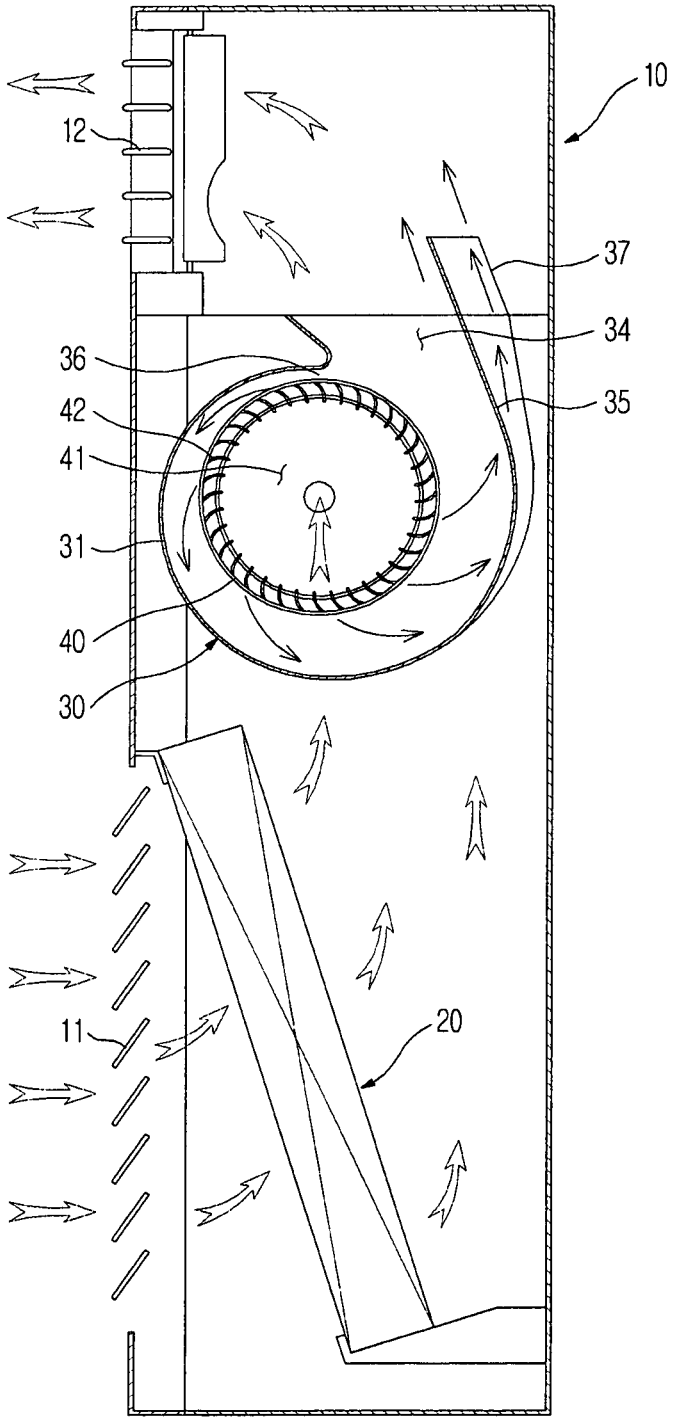
FIG. 1 is a sectional view showing a configuration of an air conditioner in accordance with an embodiment.

Reference will now be made in detail to an embodiment, examples of which are illustrated in the accompanying drawings, wherein like reference numerals refer to like elements throughout. The embodiment is described below to explain the present invention by referring to the figures. A blower used in an air conditioner as will be described hereinafter is given only by way of example, and the blower of the present embodiment can be applied to domestic and industrial appliances such as air purifiers, refrigerators, cleaners, etc.

FIG. 1 is a sectional view showing a configuration of an air conditioner in accordance with the present invention.

As shown in FIG. 1, the air conditioner in accordance with the present embodiment includes a body 10 having a suction grill 11 and a discharge grill 12 provided at a front surface thereof, a heat exchanger 20 received in the body 10 at a position corresponding to the suction grill 11, and a blower 30 to suction air having passed through the heat exchanger 20 and to forcibly blow the suctioned air toward the discharge grill 12.

The air suctioned into the body 10 through the suction grill 11 is heated or cooled while passing through the heat exchanger 20, and thereafter is forcibly blown to the discharge grill 12 by the blower 30 to be discharged to the outside of the body 10.

Figure 2:
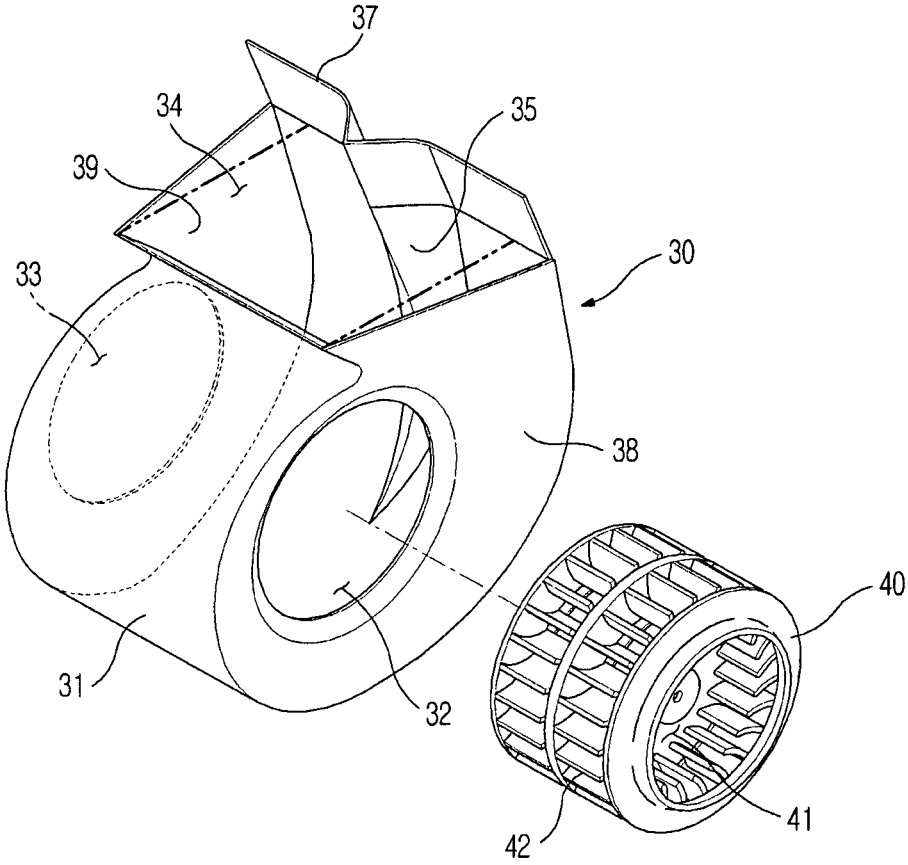
FIG. 2 is a perspective view of a blower in accordance with the present embodiment.
Figure 3:
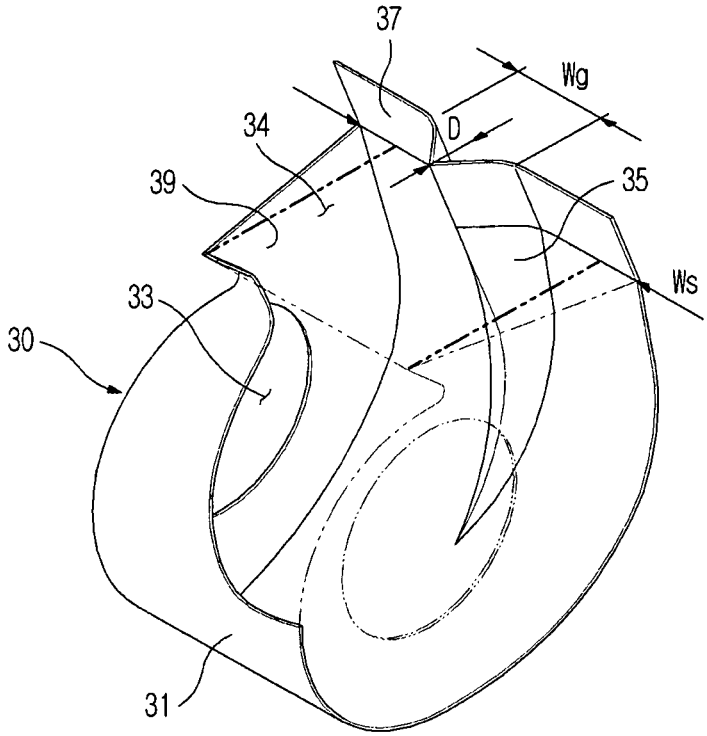
FIG. 3 is a partially cut-away perspective view of the blower in accordance with the present embodiment.

FIG. 2 is a perspective view of the blower in accordance with the present embodiment, and FIG. 3 is a partially cut-away perspective view of the blower.

As shown in FIG. 2, the blower 30 in accordance with the present embodiment includes a cylindrical scroll casing 31, and a centrifugal fan 40 received in the scroll casing 31. Two suction holes 32 and 33 are formed at opposite positions of the scroll casing 31, respectively, and a discharge hole 34 is formed at a top of the scroll casing 31. Here, the scroll casing 31 has an approximately cylindrical shape.

The centrifugal fan 40 is operated by a motor (not shown). If air is suctioned from both the suction holes 32 and 33 at opposite positions of the blower 30 into the centrifugal fan 40 along a rotating-axis direction thereof, the centrifugal fan 40 discharges the suctioned air in a radial direction. In the present embodiment, the centrifugal fan 40 is a sirocco fan having a large number of blades, but a radial fan having a smaller number of blades may be used.

The blower 30 in accordance with the present embodiment further includes a divergence guide portion 35 provided along an inner circumference of the scroll casing 31. At least a part of the air, which was suctioned from both the suction holes 32 and 33 and passed through blades 42 of the centrifugal fan 40, is diverged by the divergence guide portion 35 such that the air can be diffused to two sides, i.e., left and right sides, of the discharge hole 34.

Specifically, if the centrifugal fan 40 is rotated by a motor (not shown), a low-pressure space is created in a hollow region 41 of the centrifugal fan 40, thus causing surrounding air to be suctioned from the respective suction holes 32 and 33 toward the hollow region 41 of the centrifugal fan 40. In this case, the surrounding air having passed through both the suction holes 32 and 33 arranged at opposite positions of the blower 30 creates individually-suctioned air streams. These suctioned air streams are discharged in a radial direction from the centrifugal fan 40. While being discharged in a radial direction from the centrifugal fan 40 after passing through the centrifugal fan 40, the individual air streams suctioned from both the suction holes 32 and 33 are respectively subjected to opposing inertial forces in the rotating-axis direction of the centrifugal fan 40, in addition to a centrifugal force acting in the radial direction of the centrifugal fan 40. This causes the air streams discharged from the centrifugal fan 40 to be concentrated on a center of a flow path while flowing toward the discharge hole 34 along the scroll casing 31, thereby undergoing collision and mixing therebetween. However, in the blower 30 of the present embodiment, with the provision of the divergence guide portion 35 at an inner circumference of the scroll casing 31, at least a part of both the air streams that have biased flows toward the center of the flow path are gently turned toward opposite side surfaces 38 and 39 of the blower 30 and result in a relatively uniform and stable flow phase throughout the cross section of the discharge flow path. Accordingly, possible collision and mixing between both the air streams is reduced, and consequently flow loss and discharge noise can be reduced.

The divergence guide portion 35 of the present embodiment is formed along the inner circumference of the scroll casing 31 by inwardly bending the scroll casing 31 on the basis of a line bisecting the scroll casing 31. Although the present embodiment illustrates the divergence guide portion 35 as having a V-shaped cross section, the cross section of the divergence guide portion 35 is not limited thereto, and a variety of cross sections such as a U-shaped cross section, etc. can be used.

As shown in FIG. 3, the divergence guide portion 35 has a bending depth D and a bending width Wg, which gradually increase along an air flow direction. This configuration enables the gradual divergence of air in proportion to a compression rate of air that increases along the air flow direction.

Further, a possible flow resistance of air against the divergence guiding portion 35 during divergence can be minimized, resulting in a natural and stable divergence of air.

Referring again to FIG. 1, a beginning region of the spiral air discharge flow path, connected with the discharge hole 34, is called a cut-off region 36. The bending of the divergence guide portion 35 may start at a point between 180° and 270°, for example, in the air flow direction from the cut-off portion 36. When the bending starts at a point below 180° in the air flow direction from the cut-off region 36, the resulting divergence guide portion 35 is liable to excessively increase flow loss. Also, when the bending starts at a point beyond 270° in the air flow direction from the cut-off region 36, the resulting divergence guide portion 35 cannot achieve efficient divergence of air flow.

As shown in FIGS. 2 and 3, a width Ws of the scroll casing 31 according to the present embodiment gradually increases along the air flow direction, and correspondingly, the cross section of the discharge flow path defined between the centrifugal fan 40 and the scroll casing 31 increases along the air flow direction. Two dash-dot-dotted lines shown in FIGS. 2 and 3 represent a width of a discharge hole of a conventional blower, and it can be understood that the discharge flow path of the present embodiment gradually expands in opposite directions as compared to the conventional blower. This expanded discharge flow path can minimize possible flow loss and discharge noise caused between the air streams, which are diverged by the divergence guide portion 35 and are diffused to opposite sides of the scroll casing 31 and both the side surfaces 38 and 39 of the blower 30. In this case, an expansion angle of the width Ws of the scroll casing 31 is determined according to the shape and bending degree of the divergence guide portion 35.

The blower 30 of the present embodiment may further include a skirt portion 37 extended from the scroll casing 31 along the air flow direction, such that the divergence guide portion 35 is extended to the outside of the blower 30.

Since the scroll casing 31 and divergence guide portion 35 of the present embodiment can be integrally formed of a plastic or metal plate, for example, via simple injection molding or pressing, the blower 30 of the present embodiment is advantageous in terms of fabrication time and costs as compared to the conventional blower. Even so, the divergence guide portion 35 may be prefabricated and then be attached to the scroll casing 31.

Hereinafter, the principle of operation of the blower and an air conditioner having the same according to the present embodiment will be described with reference to FIGS. 1 to 4.

If the centrifugal fan 40 is operated by a drive motor (not shown), a low-pressure space is created in the hollow region 41 of the centrifugal fan 40, causing outside air having passed through the suction grill 11 and heat exchanger 20 to be suctioned as individual air streams into the hollow region 41 of the centrifugal portion 40 through both the suction holes 32 and 33 provided at opposite positions of the blower 30. In this case, the outside air is heated or cooled while passing through the heat exchanger 20. Both of the air streams, suctioned into the hollow region 41 of the centrifugal fan 40, are discharged in a radial direction from the centrifugal fan 40. Then, the resulting compressed air flows toward the discharge hole 34 along the inner circumference of the scroll casing 31.

Figure 4:
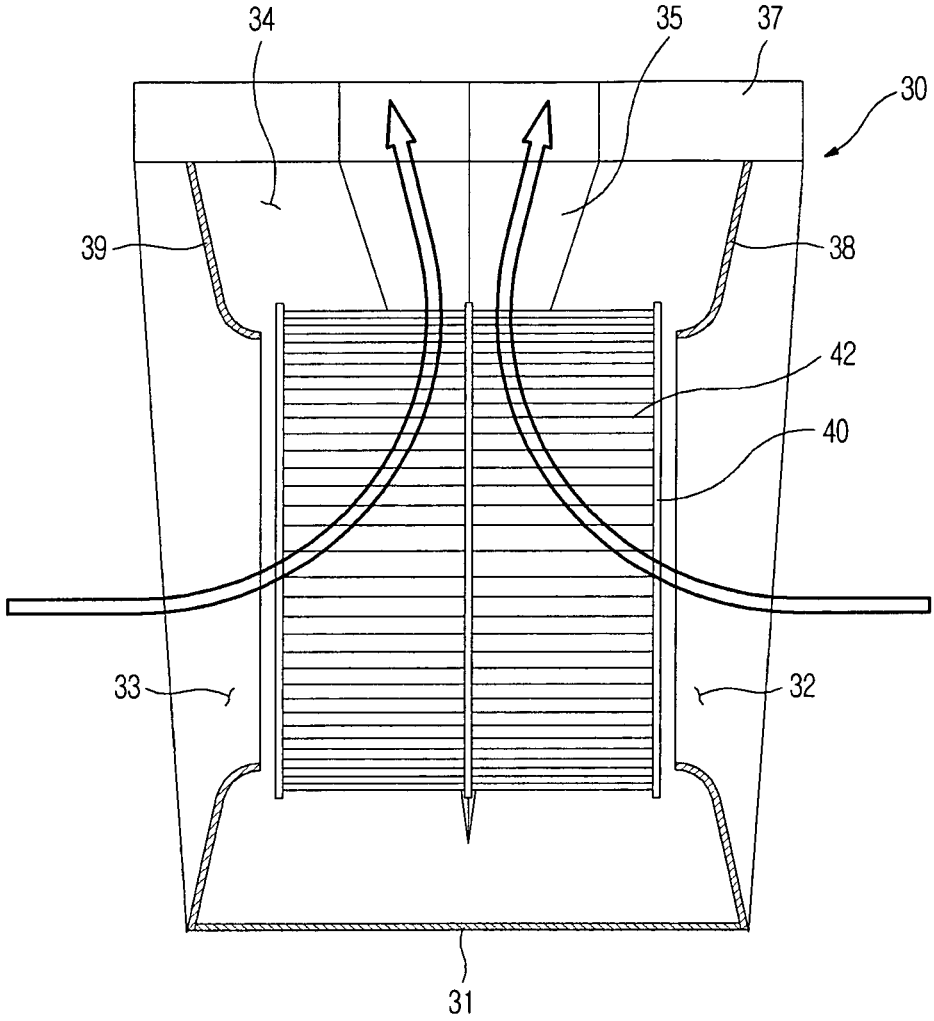
FIG. 4 is a sectional view of the blower in accordance with the present embodiment.

As shown in FIG. 4, the air, having passed through the blades 42 of the centrifugal fan 40, is gradually diverged toward both the side surfaces 38 and 39 of the blower 30 by the divergence guide portion 35 while flowing toward the discharge hole 34. In this case, a flow rate of the diverged air gradually increases. As a result, the air discharged through the discharge hole 34 shows a uniform and stable flow phase throughout the entire cross section of the discharge hole 34. Thereafter, the discharged air returns into a room through the discharge grill 12 of the body 10 of the air conditioner.

As mentioned above, the above-described air conditioner is one example, to which the blower according to the present embodiment is applied, and the blower of the present embodiment is applicable to various domestic and industrial appliances, such as air purifiers, refrigerators, cleaners, etc.

As apparent from the above description, the present embodiment provides a blower in which a divergence guide portion is formed along an inner circumference of a scroll casing, thereby restricting collision and mixing of air streams suctioned into the blower through both suction holes arranged at opposite positions of the blower, and consequently, reducing flow loss and discharge noise.

Further, the divergence guide portion of the blower according to the present embodiment is formed by bending, and this simplified fabrication is advantageous to reduce fabrication time and costs.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A blower, comprising:

a scroll casing;

suction holes provided at opposite positions of the scroll casing;

a discharge hole provided at a top position of the scroll casing which is orthogonal to the suction holes;

a centrifugal fan of a both-ends suction type received in the scroll casing; and a divergence guide portion formed along an inner circumference of the scroll casing by inwardly bending the scroll casing and extending to the discharge hole provided at the top position of the scroll casing to diverge air flowing to the discharge hole after passing through the centrifugal fan, and to diffuse the air to opposing sides of the discharge hole, wherein a bending depth and a bending width of the divergence guide portion increases along an air flow direction and a width of the scroll casing increases along an air flow direction, and the divergence guide portion is inwardly bent to have a single V-shaped cross section.

2. The blower according to claim 1, wherein a width of the scroll casing increases along an air flow direction such that a cross section of a discharge flow path expands along the air flow direction.

3. The blower according to claim 1, wherein the blower further comprises an inner cut-off region between the scroll casing and the centrifugal fan, and the divergence guide portion starts at a point between 180° and 270° in the air flow direction from the cut-off region.

4. The blower according to claim 1, wherein the divergence guide portion turns the air toward opposite side surfaces of the scroll casing.

5. The blower according to claim 1, wherein the divergence guide portion is inwardly bent along the inner circumference of the scroll casing along a central line bisecting the scroll casing.

6. The blower according to claim 1, wherein the divergence guide portion includes a skirt portion extending from the scroll casing such that the divergence guide portion is extended to an outside of the blower.

7. The blower according to claim 1, wherein the scroll casing and divergence guide portion are integrally formed of a plastic or metal plate.

8. An air conditioner, comprising:

a suction grill to suction outside air;

a heat exchanger to receive the air suctioned through the suction grill;

a discharge grill to discharge the air to the outside; and a blower to forcibly blow the outside air suctioned through the suction grill and passed through the heat exchanger to the discharge grill, the blower including a scroll casing, suction holes provided at opposite positions of the scroll casing, a discharge hole provided at a top position of the scroll casing which is orthogonal to the suction holes, a centrifugal fan of a both-ends suction type received in the scroll casing, and a divergence guide portion formed along an inner circumference of the scroll casing by inwardly bending the scroll casing, extended to the discharge hole provided at the top position of the scroll casing, to diverge air flowing to the discharge hole after passing through the centrifugal fan to diffuse the air to opposing sides of the discharge hole, wherein a bending depth and a bending width of the divergence guide portion increases along an air flow direction and a width of the scroll casing increases along an air flow direction, and the divergence guide portion is inwardly bent to have a single V-shaped cross section.

9. The air conditioner according to claim 8, wherein a width of the scroll casing increases along an air flow direction such that a cross section of a discharge flow path expands along the air flow direction.

10. The air conditioner according to claim 8, wherein the blower further comprises an inner cut-off region between the scroll casing and the centrifugal fan, and the divergence guide portion starts at a point between 180° and 270° in the air flow direction from the cut-off region.

11. The air conditioner according to claim 8, wherein the heat exchanger receives the air suctioned through the suction grill before the air is passed to the blower.

12. The air conditioner according to claim 8, wherein the scroll casing and divergence guide portion are integrally formed of a plastic or metal plate.

13. The air conditioner according to claim 8, wherein the divergence guide portion turns the air toward opposite side surfaces of the scroll casing.

14. The air conditioner according to claim 8, wherein the divergence guide portion is inwardly bent along the inner circumference of the scroll casing along a central line bisecting the scroll casing.

15. The air conditioner according to claim 8, wherein the divergence guide portion includes a skirt portion extending from the scroll casing such that the divergence guide portion is extended to an outside of the blower.

16. A blower, comprising:

a scroll casing;

suction holes provided at opposite positions of the scroll casing;

a discharge hole provided at a top position of the scroll casing which is orthogonal to the suction holes;

a centrifugal fan of a both-ends suction type received in the scroll casing; and a divergence guide portion formed along an inner circumference of the scroll casing to the discharge hole provided at the top position of the scroll casing to diverge air flowing to the discharge hole after passing through the centrifugal fan, and to diffuse the air to opposing sides of the discharge hole, wherein the divergence guide portion is protruded inwardly from an inner surface of the scroll casing along a central line bisecting the scroll casing, to have a single V-shaped cross section which decreases a cross section area of a central portion of the discharge hole, and wherein a protruded depth and a protruded width of the divergence guide portion increases along an air flow direction and a protruded width of the scroll casing increases along an air flow direction.

* * * * *